US007295170B2

(12) United States Patent
Chen

(10) Patent No.: US 7,295,170 B2
(45) Date of Patent: Nov. 13, 2007

(54) WATERPROOF MECHANISM FOR SATELLITE ANTENNA

(75) Inventor: Yung-chin Chen, Taipei Hsien (TW)

(73) Assignee: Wistron Neweb Corporation, Taipei Hsien (TW)

( * ) Notice: Subject to any disclaimer, the term of this patent is extended or adjusted under 35 U.S.C. 154(b) by 108 days.

(21) Appl. No.: 11/329,151

(22) Filed: Jan. 11, 2006

(65) Prior Publication Data

US 2007/0159409 A1 Jul. 12, 2007

(51) Int. Cl.
*H01Q 1/42* (2006.01)

(52) U.S. Cl. ..... 343/872

(58) Field of Classification Search ..... 343/872, 343/784, 786, 772, 840, 775, 779
See application file for complete search history.

(56) References Cited

U.S. PATENT DOCUMENTS 5,216,432 A * 6/1993 West ..... 343/786
5,517,203 A * 5/1996 Fiedziuszko ..... 343/756
6,111,547 A * 8/2000 Gau et al. ..... 343/786
6,191,753 B1 * 2/2001 Ellis et al. ..... 343/872
6,570,542 B2 * 5/2003 Jan et al. ..... 343/778
6,697,026 B1 * 2/2004 Hemmingsen, II ..... 343/760
6,753,823 B2 * 6/2004 Matz et al. ..... 343/760
7,187,340 B2 * 3/2007 Kralovec et al. ..... 343/781 CA

* cited by examiner

*Primary Examiner*—Huedung Mancuso
(74) *Attorney, Agent, or Firm*—Troxell Law Office, PLLC

(57) ABSTRACT

A waterproof mechanism for a satellite antenna is to separate a waterproof cover of the known technology into two components of a fixing cover and a thin wall cap used for compressing an O-ring, cause the thin wall cap and the O-ring to be combined closely and stably on the upper end of a wave-guide tube, and enable the stability and the strength of the entirety to be increased. But, the thin wall cap is unnecessary to have a same thickness as the fixing cover. Therefore, the thickness of the thin wall cap can approximately be reduced to 3 mm. This can increase broadly the passing rate of satellite signal and allow a low noise block with integrated feed (LNBF) to have a better satellite signal receiving effect.

5 Claims, 2 Drawing Sheets

WATERPROOF MECHANISM FOR SATELLITE ANTENNA

BACKGROUND OF THE INVENTION

1. Field of the Invention

The present invention relates to a satellite antenna, and more particular to a waterproof mechanism for a satellite antenna.

2. Description of Related Art

A general satellite antenna system is to place a low noise block with integrated feed (LNBF) at a plane where the focus of an antenna dish is located so as to receive satellite signals.

U.S. Pat. No. 6,570,542 discloses an integrated dual-directional feed horn, for receiving radio frequency (RF) signals from two satellites in a small angle, includes a first LNBF and a second LNBF.

U.S. Pat. No. 6,191,753 discloses a rigid cover for satellite antennas. The cover prevents rain from passing between a dish member and a converter assembly of the satellite antenna. The cover may be designed for a particular style of the satellite antenna. The cover may be designed for a particular style of satellite antenna or, preferably, have a mounting portion adapted to accommodate a plurality of styles of satellite antennas.

LNBF disclosed in U.S. Pat. No. 6,570,524 mentioned above has no design of a waterproof cap at the opening end of a wave-guide tube thereof so that rain flows easily into the inner part of the wave-guide tube to damage the LNBF.

A cover disclosed in U.S. Pat. No. 6,191,753 shields the signal receiving face of a whole dish member and a converter assembly. The design thereof allows the converter assembly not to be exposed to the rain, but because its cover shields the signal receiving face of the dish member, it would influence the satellite signal receiving effect. Furthermore, because the volume of the cover is very large, the production cost is rather high.

Because the LNBF is an outdoor product, for preventing the LNBF from being damaged by the rain, it is usually to collocate a waterproof cap in the front of the wave-guide tube of the LNBF to maintain the normal functions and the life of the LNBF.

Because the top thickness of the waterproof cap will influence the satellite signal receiving effect, there are two methods used at the present: an O-ring is used for combining between the waterproof cap and the wave-guide tube and adhesive is used for sticking a thin film and the wave-guide tube. The common used method is the design using O-ring combination because the method using the adhesive for combing is rather time wasting.

The practice using O-ring combination is to integrate an O-ring pressing mechanism with the waterproof cap. But, because of the limitation of the present mold injection, such kind of practice will cause the thickness of the top of the waterproof cap is rather thick to influence the receiving effect of signals. If we want the thickness of the top of the waterproof cap to be thinner, a thin film must be adopted. But, because the thickness of the thin film is thinner, it cannot be integrated with the pressing mechanism. If the thin film is forced to be integrated with the O-ring pressing mechanism, deformation and shrinkage are caused because the difference of the thick and the thin parts are overlarge to lead to the waterproof effect to be in vain. Therefore, the adhesive stuck method must be used for attaining to a waterproof effect, but it also increase the needed combining time.

SUMMARY OF THE INVENTION

For improving the deficiencies of the present convention waterproof mechanism for a satellite antenna, the present invention is proposed.

The main object of the present invention is to provide a waterproof mechanism for a satellite antenna, capable of using an O-ring to cause the waterproof mechanism to be combined airtightly with the wave-guide tube, and obtaining a better satellite signal receiving effect.

Another effect of the present invention is to provide a waterproof mechanism for a satellite antenna, allowing a fixing cover and thin wall cap to be manufactured separately, the fixing cover is consequently able to have a thicker wall, and can increase the stability and the strength of the entirety after it is combined with a wave-guide tube.

BRIEF DESCRIPTION OF THE DRAWINGS

The present invention can be more fully understood by reference to the following description and accompanying drawings, in which.

DETAILED DESCRIPTION OF THE PREFERRED EMBODIMENTS

The present invention processes an improved design directed against the problems of the conventional waterproof mechanism for a satellite antenna mentioned above. Not only must a waterproof cap maintain the waterproof function on a satellite antenna, but also must the material thickness of a waterproof cap be considered to avoid influencing the satellite signal receiving effect to lead to a bad signal receiving and the decreasing and the failure of the functions of a product.

Figure 1:
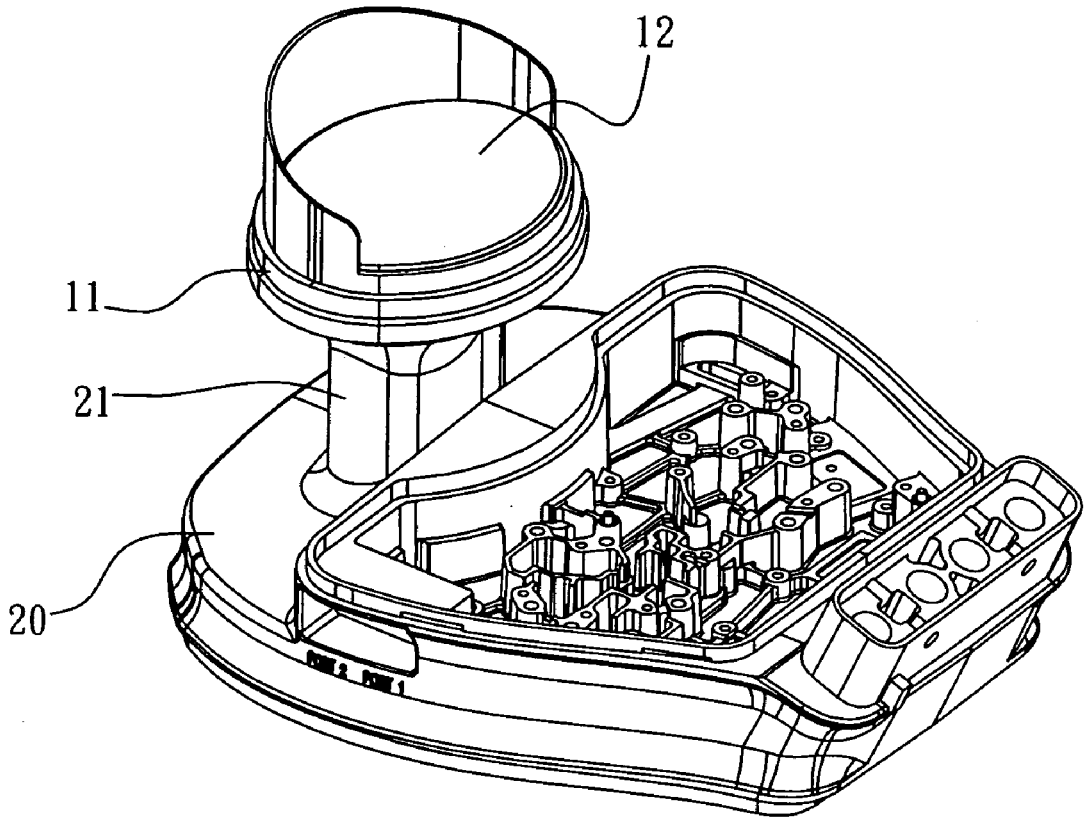
FIG. 1 is a perspective view, showing a waterproof mechanism combined with a wave-guide tube of a LNBF according to the present invention.
Figure 2:
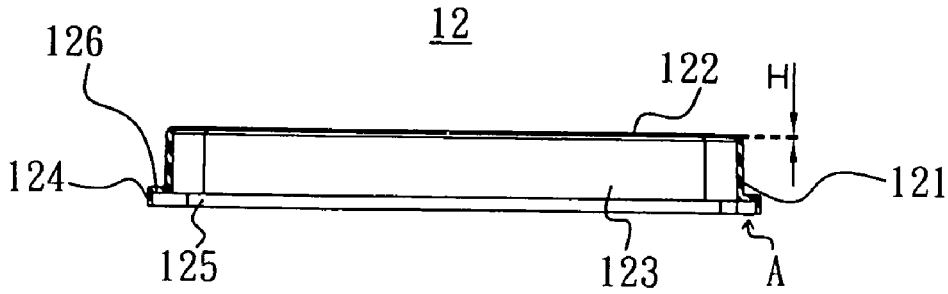
FIG. 2 is a cross sectional view, showing a thin wall cap of the present invention.
Figure 3:
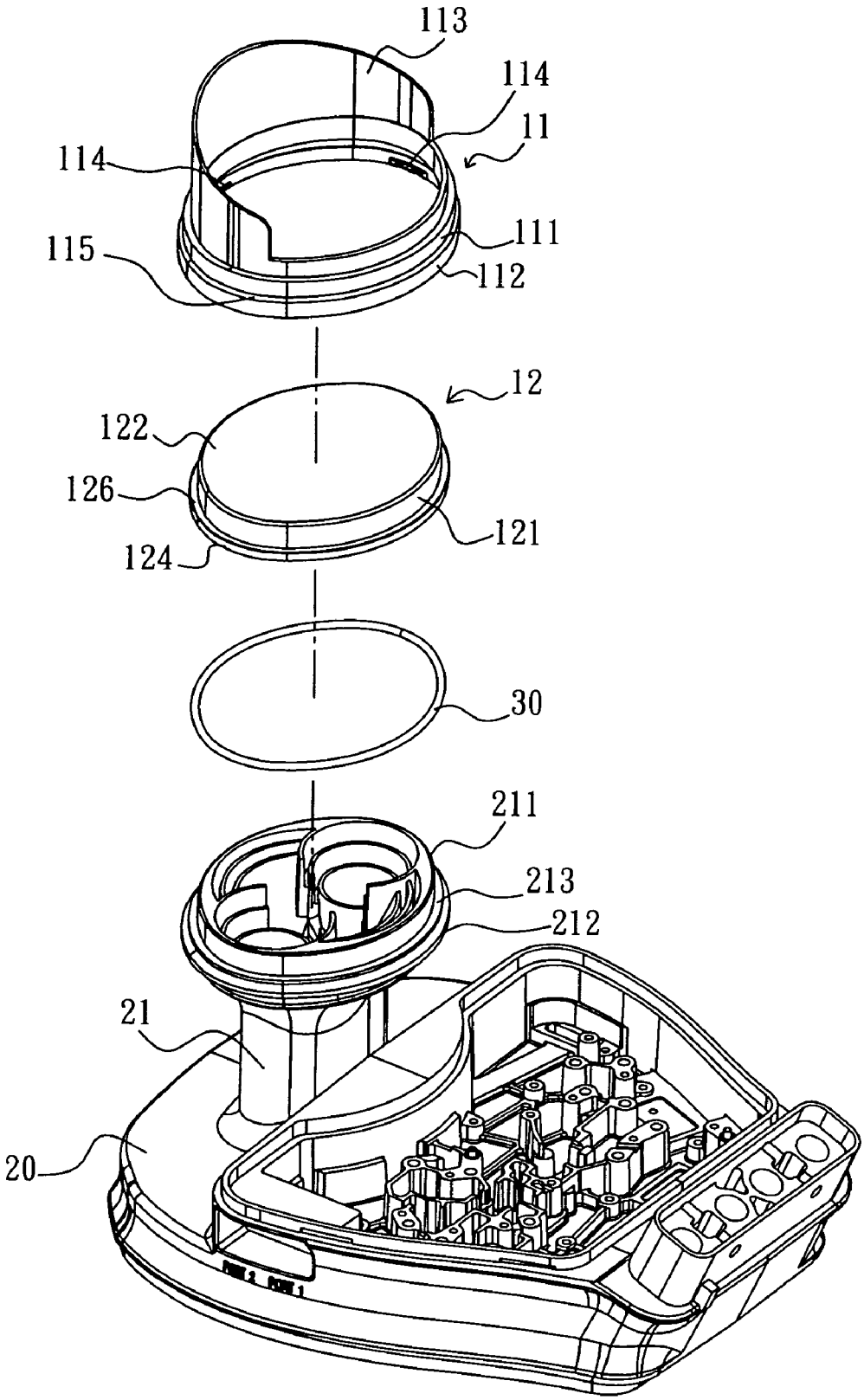
FIG. 3 is an exploded view, showing a waterproof mechanism accompanying with a LNBF according to the present invention.

Please refer to FIGS. 1, 2 and 3. The present invention is to separate the waterproof cap of the known technology into two parts of a fixing cover 11 and a thin wall cap 12. The fixing cover 11 and the thin wall cap 12 are operated in coordination with an O-ring 30 to be combined at the upper end of a wave-guide tube 21 of a LNBF 20 to enable rain not to enter the inner portion of the wave-guide tube 21, as FIG. 3 shows. Another function of the thin wall cap 12 is used for decreasing the hindrance of satellite signals. The function of the fixing cover 11 or so-called rain cover is used for fixing the thin wall cap 12 and O-ring 30 on the wave-guide tube 21 of the LNBF 20 to enable the stability and the strength of the entirety to be increased to attain to the waterproof effect. The outward appearances of the fixing cover 11 and thin wall cap 12 are matched up with the one of the wave-guide tube 21 and can be a shape such as a circular, elliptical or square shape.

As FIG. 3 shows, the fixing cover 11 is formed in one body, and has a ring type first engaging portion 111, second engaging portion 112, in which the diameter of the second engaging portion 112 is larger. The second engaging portion 112 is connected to the lower end of the first receiving portion 111. A shielding sheet 113 is extended upwards from the upper end of the first engaging portion 111. A combining component fixedly combined with the wave-guide tube 21 is disposed at the lower end of the second engaging portion 112, for example, at least two hooks 114 are disposed on the inner wall of the lower end of the second engaging portion 112. The ring type sheet 115 is formed at the upper end of the second engaging portion 112.

Please refer to FIGS. 2 and 3, the thin wall cap 12 is formed in one body from plastic material and has a first engaging portion 121 and second engaging portion 124, in which the diameter of the second engaging portion 124 is larger. A shielding sheet 122 is disposed at the upper end of the first engaging portion 121 and the shielding portion seals a first ring type hole 123 of the first engaging portion 111. The second engaging portion 124 is connected to the lower end of the first engaging portion 121. The second engaging portion 124 has a second ring type hole 125. The diameter of the second ring type hole 125 is larger than the first ring type hole 123. A ring type sheet 126 is formed at the upper end of the second engaging portion.

As FIG. 3 shows, the upper end of the wave-guide tube 21 of the LNBF 20 has an engaging portion 211 and ring type flange 212 respectively corresponding to the first engaging portion 121 and the second engaging portion 124 of the thin wall cap 12. Combining components corresponding to the combining components of the fixing cover 11 are disposed at the lower end of the wave-guide tube, for example, at least a ring type flange 212 corresponding to the hooks 114 of the fixing cover 11. The hooks 114 can be buckled at the surfaces of the lower ends of the flange 212 to cause the first engaging portion 121 and the second engaging portion 124 of the thin wall cap 12 to be sandwiched by the fixing cover 11 and the wave-guide tube 21.

As FIGS. 1, 2 and 3 show, the O-ring 30 is put around the periphery of the first engaging portion 211 of the wave-guide tube 21 and placed at the upper side of an upper end face 213 of the flange 212. The first engaging portion 121 of the thin wall cap 12 is engaged at the periphery of the first engaging portion 211 of the wave-guide tube 21 and the shielding sheet 122 seals the opening of the wave-guide tube 21. The O-ring 30 is engaged in an area A inside the second engaging portion 124 of the thin wall cap 12. The first engaging 111 of the fixing cover 11 is engaged at the periphery of the first engaging portion 121 of the thin wall cap 12, the second engaging portion 112 is engaged at the periphery of the second engaging portion 124 and the ring type flange 212 of the thin wall cap 12, and the hooks 114 are caused to buckle at the lower end face of the ring type flange 212 to allow the fixing cover 11, thin wall cap 12 and O-ring 30 to be stably combined at the upper end of the wave-guide tube 21.

As FIGS. 2 and 3 show, the present invention is to separate the conventional waterproof cover into two components of the fixing cover 11 and the thin wall cap 12, and then use the O-ring 30 to attain to the waterproof function. Here, the shielding sheet 122 of the thin wall cap 12 is an area for satellite signals to pass through; the thickness "H" of the shielding sheet 122 will influence the satellite signal receiving capability of the LNBF 20. Therefore, the influence of the thickness to the satellite signals must be considered to fit a customer's requirement when the thickness of the shielding sheet 122 is designed. The area "A" of the shielding sheet is an area for causing the O-ring 30 to be deformed, the value of the pressing amount must be considered to decide the size thereof when this area is planned. The thin wall cap 12 is then assembled onto the O-ring 30 after the O-ring 30 is assembled on the LNBF 20. At this time, the O-ring 30 yields no deformation even if the pressing from the assembly of the thin wall cap 12. But, if the fixing cover 11 is further assembled onto the LNBF 20, the upper end of the ring sheet 126 of the thin wall cap 12 will cause the O-ring 30 to be deformed synchronically and sandwiched between the ring shape sheet 126 of the second engaging portion 124 of the thin wall cap 12 and the upper end face 213 of the flange 212 of the wave-guide tube 21 because the ring shape sheet 115 of the fixing cover 11 is pushed in to press. The O-ring 30 is caused to fill up the whole area "A" to attain to the waterproof function when the entirety of the fixing cover 11 is engaged with the LNBF 20.

Because the waterproof cover of the known technology is to integrate the mechanism of pressing O-ring with the waterproof cover together, the thickness thereof must reach at least 8 mm and over. But, the present invention is to separate the waterproof cover of the known technology into two components of the fixing cover and the thin wall cap for pressing O-ring. The fixing can have a large thickness to press the O-ring and cause the thin wall cap and O-ring to be combined closely and stably at the upper end of the wave-guide tube, it can increase the stability and the strength of the entirety. But, it is unnecessary for the thin wall cap to have a same thickness as the fixing cover. Therefore, the thickness of the thin wall cap 12 can be approximately reduced to 3 mm; this can broadly increase the passing rate of the satellite signals to allow the LNBF to have a better satellite signal receiving effect.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A waterproof mechanism for a satellite antenna, used for preventing water from entering a wave-guide tube of a low noise block with integrated feed (LNBF), comprising:

a fixing cover, having a ring type engaging portion, the lower end of said ring type engaging portion having a ring type sheet and combining component;

a thin wall cap, having a ring type engaging portion, the upper end of said ring type engaging portion having a shielding sealing an opening thereof and the lower end of said ring type engaging portion having a ring type sheet;

an O-ring; and said LNBF, comprising said wave-guide tube, said wave-guide tube having a ring type engaging portion and combining component corresponding respectively to said engaging portion and ring type sheet of said thin wall cap, said combining component being also corresponding to said combining component of said fixing cover;

wherein said ring type engaging portion of said thin wall cap is engaged at the periphery of said ring type engaging portion of said wave-guide tube; said ring shape engaging portion of said fixing cover is engaged at the periphery of said ring type portion of said thin wall cap; said combining component of said fixing cover is combined with said combining component of said wave-guide tube; said ring sheet of said fixing cover presses said ring type sheet of said thin wall cap, said O-ring is sandwiched between said ring sheet of said thin wall cap and the upper end face of said ring shape of said engaging portion.

2. The waterproof mechanism according to claim 1, wherein said combining component of said fixing cover is at least two hooks disposed inside of said ring type engaging portion; said combining component of said fixing cover; said combining component of said wave-guide tube is a flange; said hooks are connected with said flange at the lower end face thereof.

3. The waterproof mechanism according to claim 1, wherein said engaging portion of said thin wall cap is sandwiched by engaging portion of said fixing cover and said engaging portion of said wave-guide tube.

4. The waterproof mechanism according to claim 1, wherein said ring type engaging portion of said fixing cover has a first engaging portion and a second engaging portion connected with each other, the diameter of said second engaging portion is larger the said first engaging portion and located below said first engaging portion;

said engaging portion of said thin wall cap has a first engaging portion; and a second engaging respectively corresponding to said engaging portion and said second engaging portion of said fixing cover; said ring type sheets of said fixing cover and said thin wall cap respectively are the upper end face of said fixing cover and the upper end face of said second engaging portion of said thin wall cap.

5. The waterproof mechanism according to claim 1, wherein the thickness of said shielding sheet of said thin wall cap is between 0.3 mm and 0.8 mm.

* * * * *